United States Patent [19]

Hepfer et al.

[11] Patent Number: 4,641,975

[45] Date of Patent: Feb. 10, 1987

[54] CLOCK WITH MECHANICAL DRIVE

[75] Inventors: Rolf Hepfer, Bad Dürrheim; Rudolf Kieninger, Aldingen, both of Fed. Rep. of Germany

[73] Assignee: Joseph Kieninger Uhrenfabrik GmbH, Fed. Rep. of Germany

[21] Appl. No.: 838,104

[22] Filed: Mar. 10, 1986

[30] Foreign Application Priority Data

Mar. 11, 1985 [DE] Fed. Rep. of Germany ..... 3508637

[51] Int. Cl.[4] ..... G04C 3/00

[52] U.S. Cl. ..... 368/124; 368/155; 368/160; 368/165

[58] Field of Search ..... 368/76, 124–125, 368/134–136, 155–157, 160, 165–166, 179, 181, 75, 203, 315

[56] References Cited

U.S. PATENT DOCUMENTS

| | | | |
|---|---|---|---|
| 2,796,728 | 6/1957 | Knudsen | 368/179 |
| 3,699,762 | 10/1972 | Zatsky | 368/158 |
| 3,884,034 | 5/1975 | Dietsch | 368/158 |
| 3,952,497 | 4/1976 | Schulz et al. | 368/158 |
| 3,999,369 | 12/1976 | de Valroger et al. | 368/124 |

*Primary Examiner*—Vit W. Miska

*Attorney, Agent, or Firm*—McGlew and Tuttle

[57] ABSTRACT

In a clock provided with a mechanical drive for the going train and having one or more striking mechanisms controlled by the going train, the motion regulator of the going train comprises a quartz-controlled stepping mechanism whose arbor is in drive connection with the wheelwork of the going train via an escapement. The connection insures that each step of its arbor releases the going train subject to the torque of the mechanical drive for a defined angle. Thereby it becomes possible to use for the going train a commercial, i.e. low-torque, quartz controlled stepping mechanism and yet to have available the torques required for the control of one or more striking mechanisms. It is of advantage if, between the arbor of the stepping mechanism and the wheelwork of the going train gear, elements in the form of a pallet controlled by a cam plate or in the form of a worm wheel engagement are provided, which gear elements remain in self-lock but are releasable from the self-lock by the arbor.

9 Claims, 5 Drawing Figures

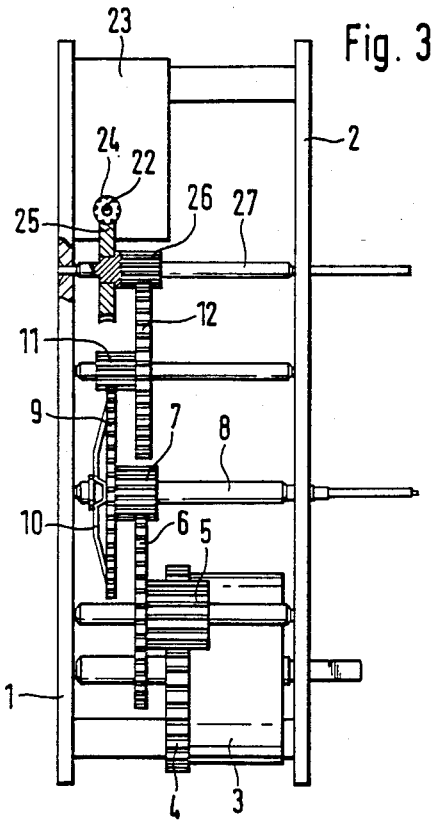
Fig. 3
Fig. 5
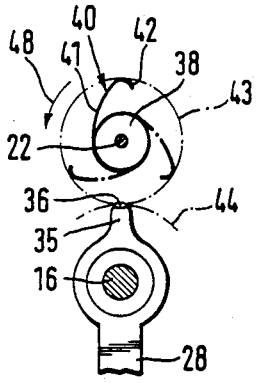
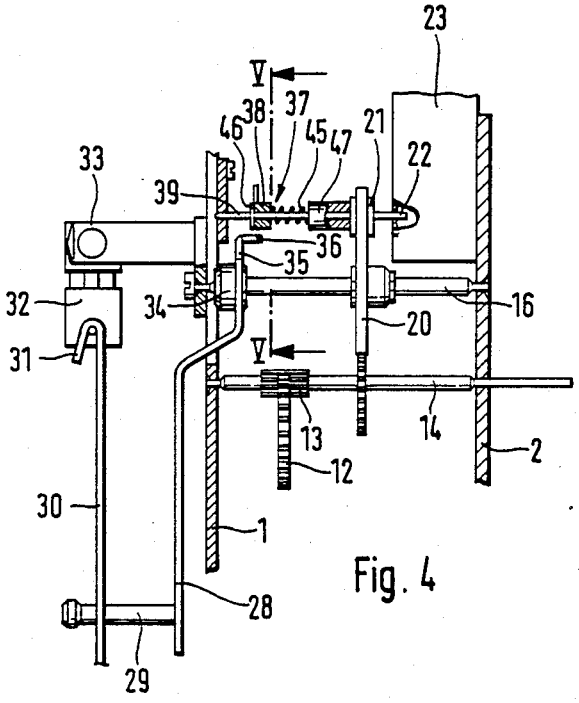
Fig. 4

CLOCK WITH MECHANICAL DRIVE

FIELD AND BACKGROUND OF THE INVENTION

The invention relates in general to horological instruments and in particular to a new and useful clock with a mechanical drive for the going train, in particular a striking clock, where the going train controls one or more striking works which are driven mechanically.

By clocks must be understood in connection with the invention those timepieces which are larger than quartz alarm clocks, have a mechanical going train driven either by weight or by spring, and which is customarily controlled by an escapement governor with a gravity pendulum or a spring pendulum (balance). Depending on the type of case, this may be a wall, floor, or table clock, while in small clocks, e.g. alarm clocks, table clocks and wall clocks without striking mechanism but equipped with an analog, i.e. conventional hand indicator device, quartz controlled stepping mechanisms are used predominantly.

Quartz controlled stepping mechanisms, which have long been produced in large quantities and therefore are available at low prices, have, however, not been used until now for clocks of this kind, in particular because of the drive torques required for the drive of the mechanical going trains and the control of mechanical striking mechanisms. The commercial quartz controlled stepping mechanisms laid out for small drive torques, and whose electromagnetic transducers consist as a rule of a battery operated step motor, are not suitable for large clocks because they are not able to drive the large wheelworks with their relatively high friction losses and to actuate the mechanical control levers of the striking works.

SUMMARY OF THE INVENTION

The invention provides a clock which may be used for the going train a commercial, quartz controlled stepping mechanism and also to ensure a drive torque sufficient both for the drive of the wheelwork and for the drive of the control levers of one or more striking mechanisms.

According to the invention, the motion regulator of the going train comprises a quartz controlled stepping mechanism whose drive shaft is in drive connection with the wheelwork of the going train via an escapement in such a way that each step of its arbor releases the going train subject to the torque of its mechanical drive for a defined angle.

The special advantage of this is that the entire mechanical going train can be left in its conventional form and only the motion regulator is replaced by a more cost efficient and more exact quartz controlled stepping mechanism. The possibility also exists to drive, by means of the quartz controlled stepping mechanism, a swinging gravity pendulum, which however is retrained only as a style element and exerts no regulating function. By the escapement it is ensured that the steps of the quartz controlled stepping mechanism are transmitted isogonally to the going train and that the mechanical drive of the going train does not impair the accuracy of the quartz controlled stepping mechanism. Only thereby is it possible to use, in combination with a mechanical drive, a quartz controlled stepping mechanism of commercial design, i.e. with a small torque.

In accordance with a further development of the invention, a quartz controlled stepping mechanism moves a pallet back and forth by an intermittently rotating means to provide a very simple, cost efficient, reliable possiblity, which requires no adjustment at all which respct to its accuracy, for the realization of an escapement actuated by the quartz controlled stepping mechanism.

Through the development of the invention, it is possible also in those quartz controlled stepping mechanisms where the arbor executes two or more switching steps per revolution to realize extremely simple transmissions, so that the pallet wheel arbor can be at the same time a seconds arbor which executes in one minute one full revolution, for example in sixty steps. In addition, it is ensured that with each step of the stepping mechanism also a step of the pallet wheel takes place.

There is another also very simple possibility of providing a self-locking drive connection between the arbor of the quartz controlled stepping mechanism and the going train subject to the drive torque of a mechanical drive.

By the worm gear provided therein, high transmission ratios or reductions can be realized in a very simple manner, here too, it is readily possible to let the worm wheel operate at the same time as a seconds wheel, or the worm wheel arbor as a seconds arbor.

Accordingly it is an object of the invention to provide a clock having a mechanical drive for a striking clock which has a going train with wheelwork which controls a mechanically driven striking works, comprising a motion regulator of the going train including a quartz controlled stepping mechanism having an arbor in drive connection with the wheelwork of the going train, an excapement connected between the arbor and the wheelwork in such a way that the arbor of the wheelwork releases the going train urged by the torque of a mechanical drive for drive through a predetermined angle.

A further object of the invention is to provide a clockwork which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BREIF DESCRIPTION OF THE DRAWINGS

In the drawings:

FIG. 3 is a view similar to FIG. 1 of a mechanical going train, which is controlled by a quartz controlled stepping mechanism by way of another escapement device;

FIG. 4 is a view similar to FIG. 1 of a drive device for a pendulum, serving merely as style element, of a going train controlled by a quartz controlled stepping mechanism and provided with a mechanical drive; and FIG. 5 is a partial section taken along the line V—V of FIG. 4.

DESCRIPTION OF THE PREFERRED EMBODIMENTS

Figure 1:
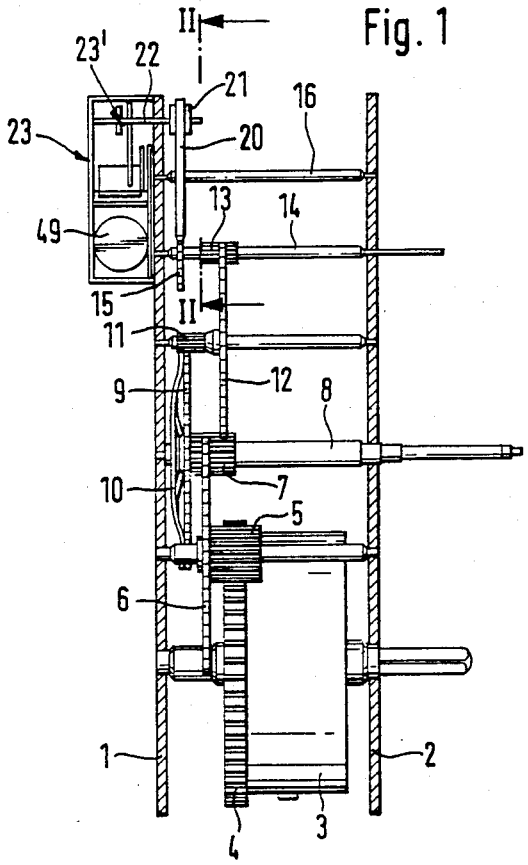
FIG. 1 is a transverse sectional view of a mechanical going train with a quartz controlled stepping mechanism as motion regulator.

Referring to the drawings in particular, the invention embodied therein comprises a clock having a mechanical drive for a striking clock 1 which has a mechanical going train including two case plates 1 and 2 and the drives and gear wheels are secured on arbors which are rotatably mounted in the case plates.

FIG. 1 shows a mechanical going train comprising two case plates 1 and 2 in which the barrel 3 is disposed and mounted in the usual manner. The toothed rim 4 of barrel 3 is in engagement with an intermediate wheel drive 5, the intermediate wheel 6 of which is in engagement with the minutes wheel drive 7 of the minutes arbor 8. The minutes wheel 9, which is non-rotationally connected with the minutes wheel drive and which drives the minutes arbor by way of a friction clutch 10, is in engagement with an additional intermediate wheel drive 11 of an intermediate wheel 12, which in turn meshes with a pallet wheel arbor drive 13. This pallet wheel arbor drive 13 is mounted on a pallet wheel arbor 14, on which also a pallet wheel 15 is disposed non-rotationally. The drives and gear wheels are secured on arbours which are rotatably mounted in the case plates 1 and 2 in the usual manner. Disposed over the pallet wheel arbor 14, on a pallet arbor 16, is a pallet 20 provided with claws 17 and 18, which need not have any lift surfaces, and with a two-armed pallet fork 19. Disposed in the pallet fork 19 is a cam plate 21 provided with three cams and hence of approximately triangular form, which is secured on an arbor 22 of a quartz controlled stepping mechanism 23. This quartz controlled stepping mechanisms 23 is fed by a commercial battery 49 and comprises as transducer a step motor 23', the arbor 22 of which executes seconds steps of 120°, that is, requiring three steps for one complete revolution.

Figure 2:
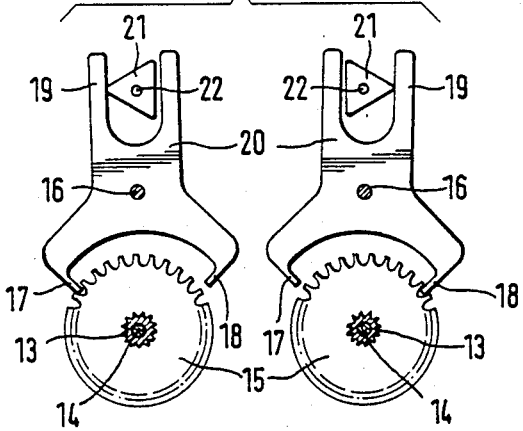
FIG. 2 is a plan view of the escapement of FIG. 1 is a sectional view II—II with two different pallet positions.

The cam plate 21 therefore has three cams, i.e. it is triangular. With each step the pallet 20 is rotated about the axis of its pallet wheel 16 in the manner shown in FIG. 2 in such a way that one of its two claws 17 or 18 comes alternately in engagement with the pallet wheel 15 and so the latter can rotate forward by one half tooth division. This means that the pallet wheel 15 must be equipped with thirty teeth if the pallet wheel arbor 14 is to be operated at the same time as seconds arbor, which executes one full revolution in sixty steps.

The drive of the pallet wheel 15, i.e. of the entire going train and hence also of the minutes arbor 8, occurs from the mechanical accumulator of the barrel 3, so that the quartz controlled going train 23 must bring about merely the torque for the rotation of pallet 20 from one engagement position to the other, for which a very small torque is sufficient.

In the form of realization of FIG. 3, in the place of the pallet 20, pallet wheel 15 another self locking drive connection between arbor 22 of the quartz controlled stepping mechanism 23 and the going train is provided. There, a worm 24 in engagement with a worm wheel 25 is secured on the arbor 22. Worm wheel 25 is disposed on a drive 26 of the seconds arbor 27 of a going train which otherwise corresponds to the construction of the going train of FIG. 1. It can be seen from FIG. 3 that in this case the quartz controlled stepping mechanism 23 must be arranged, not outside case 1 as in FIG. 1, but inside case 1, so that arbor 22 extends crosswise to the axle of worm wheel 25 and hence also to the other transmission axles. Assuming that worm 24 has a single spiral and worm wheel 25 has twenty teeth, the seconds arbor 27 makes per step an angular movenent of 6° (1/60 revolution) if the arbor 22 with worm 24 executes with each step an angular movement of 120°.

In FIGS. 1 and 3, the dial trains and also the stroking mechanisms customary in such clocks and the control organs for such striking mechanisms are not shown for reasons of clarity, as they are not needed for comprehension of the invention.

In FIGS. 4 and 5 is shown a possibility how to impart to a gravity pendulum, which normally is connected with a so-called pointer lever 28 via a pin 29 in engagement with the pendulum suspension 30, the drive pulses required for maintaining its swinging motion. The pendulum suspension 30, which at its upper end is fastened by a forked hook 31 to a pendulum spring 32, is suspended in the usual manner from a bearing pin 33 fastened on the back of the case plate 1. The upper cranked end of pointer lever 28, passed inwardly through the case plate 1, is mounted by means of a bushing 34 for rotation on the pallet arbor 16, and it has a second lever arm 35 extending upward, with a cross finger 36 which protrudes into the movement path of a switching organ 37. This switching organ 37 consists of a bushing 38, which is mounted on a shaft 39 extending coaxially with the arbor 22 of the quartz controlled stepping mechanism 23 arranged in this case on the inner side of case plate 2, which arbor 39 has at its circumference a finger 40 in the form of a curved leaf spring 41 extending radially outward, the outer end section 42 of which is rounded inwardly and moves in the arrow direction 48 during the step movements of arbor 22 on a circular path 43 which intersects the circular orbit 44 of the cross finger 36. In so doing, the switching finger 40 extends in circumferential direction over an angle of about 90°. It could be provided also that the bushing 38 is equipped with three or with two such fingers 40. This depends, among other things, on the ratio between the swinging time of the pendulum and the steps of arbor 22 of the quartz controlled stepping mechanism 23. For such cases, it is best, at any rate, if a stepping mechanism 23 is used whose arbor 22 executes an even number of steps per revolution, for example two or four steps per revolution, and if the pendulum executes one half swinging movement per step. It is then assured, provided synchronism exists, that the cross finger 36 of the second lever arm 35 of the pointer lever 28 moves with each step of arbor 22 in the same direction as the switching finger or fingers 40 arranged on bushing 38.

To avoid harmful reactions on the arbor 22 or on the quartz controlled going train 23 even when possibly a switching finger 40 and the cross finger 36 move in opposite directions during a switching step, the finger 40 is designed as a leaf spring which yields radially inward and hence can slide over the cross finger 36 without harm. Another possiblity of avoiding such harmful inhibiting effects at the arbor 22 is given by the friction clutch existing between the bushing 38 and arbor 39. A compressor spring 45 is arranged between a cylindrical coupling piece 47 of arbor 39, by which arbor 39 is non-rotationally connected with arbor 22. The spring 45 presses the bushing 38 rotatably mounted on arbor 39 against an abutment disk 46 of arbor 39 and thereby produces, between bushing 38 and arbor 39, a friction moment which causes the entrainment of bushing 38 with every rotation of arbor 39, but which is only strong enough that arbor 22 is not prevented from exerting its regulating function even when, for any reason, bushing 38 cannot rotate synchronously with arbor 39 or with arbor 22. Still other forms of realization of devices are conceivable by which the drive pulses required to maintain the oscillation of the pendulum can be applied to the pendulum. Thus, for example, it would be conceivable to arrange on the seconds arbor 14, which receives its drive from the mechanical accumulator of barrel 3, several switching arms 40 in the above described manner, which, by a cross pin disposed on a downwardly extending lever arm of the upper pointer lever end, come into non-positive connection periodically to deliver the drive pulse to the gravity pendulum. Another possibility would be to provide a non-positive connection directly between pallet 20 and bushing 34 of the upper pointer lever end; this could be realized for example in that the pallet 20 is fastened on the pallet arbor 16 by means of a friction clutch and bushing 34 of the pointer lever 28 is non-rotational on pallet arbor 16. In that case, however, the drive pulse for maintaining the pendulum motion would again be derived from the switching arbor 22.

While specific embodiments of the invention have been shown and described in detail to illustrate the application of the principles of the invention, it will be understood that the invention may be embodied otherwise without departing from such principles.

What is claimed is:

1. A clock having a mechanical drive for driving a striking clock having a striking clock mechanism, said striking clock mechanism including a mechanical striking clock drive having a wheelwork, a going train connected to said striking wheelwork, a quartz controlled stepping mechanism having an arbor in drive connection with the wheelwork of said going train, an escapement connected between said wheelwork and said arbor, said escapement including means following each step of said arbor releasing the going train, said mechanical drive producing a torque acting on said means for driving it through a defined angle.

2. A clock according to claim 1, including a pallet wheel gear train between said arbor and said quartz controlled stepping mechanism in self-locking engagement therebetween, said stepping arbor being capable of releasing said gear train self-locking.

3. A clock according to claim 2, wherein the arbor of said quartz controlled stepping mechanism is connected to said pallet to move said pallet backwardly and forwardly between two end positions, said connection including an intermittently rotatable eccentric member.

4. A clock according to claim 3, wherein said eccentric member comprises a cam plate having radial extending cam portions disposed at regular angular distances from each other and regulating the arbor of said quartz controlled stepping mechanism to a selected number of steps for one complete revolution.

5. A clock according to claim 1, wherein said going train as a worm wheel which is in self-locking engagement with the arbor of said quartz controlled stepping mechanism.

6. A clock according to claim 4, including a gravity pendulum driven in a pulsed manner by the arbor of said quartz controlled stepping mechanism by drive means, said drive means comprising intermittently revolving driven elements having one or more radially extending switching fingers, and a two-armed lever having a lever arm engaged with said switching fingers and having a pointing portion.

7. A clock according to claim 6, wherein said switching element is in drive connection with the arbor of said quartz controlled stepping mechanism and including a friction clutch providing a drive connection between said switching element and said quartz controlled stepping mechanism.

8. A clock according to claim 6, wherein said switching element switching finger comprises a drive spring element.

9. A clock according to claim 8, wherein said spring elements have the form of a radially ascending curve extending over an angle of for 90° to 120° and having outer end sections lying on a circular path intersecting the pivot path of said lever arm of pointer lever.

* * * * *